US005782130A

United States Patent [19]

Sawdon

[11] Patent Number: 5,782,130

[45] Date of Patent: Jul. 21, 1998

[54] APPARATUS FOR RETAINING TOOLS

[75] Inventor: Edwin G. Sawdon, St. Clair, Mich.

[73] Assignee: BTM Corporation, Marysville, Mich.

[21] Appl. No.: 788,242

[22] Filed: Jan. 27, 1997

Related U.S. Application Data

[63] Continuation of PCT/US94/08561, Jul. 29, 1994.

[51] Int. Cl.[6] ..... B21D 37/14

[52] U.S. Cl. ..... 72/481.8; 72/482.94; 83/698.71; 83/698.91

[58] Field of Search ..... 72/481.3, 481.5, 72/481.6, 481.7, 481.8, 481.9, 482.94; 83/698.71, 698.91

[56] References Cited

U.S. PATENT DOCUMENTS

| | | |
|---|---|---|
| 1,190,696 | 7/1916 | Wilzin . |
| 1,211,333 | 1/1917 | Miller . |
| 1,404,126 | 1/1922 | Krause . |
| 1,778,339 | 10/1930 | Rafter . |
| 2,028,354 | 1/1936 | Roe . |
| 2,670,885 | 3/1954 | Allen . |
| 2,816,288 | 12/1957 | Heilman et al. . |
| 3,269,168 | 8/1966 | Anderson . |
| 3,359,935 | 12/1967 | Rosbottom . |
| 3,404,648 | 10/1968 | Rosbottom . |
| 3,468,527 | 9/1969 | Mather . |
| 3,690,141 | 9/1972 | Brownbill . |
| 3,730,044 | 5/1973 | Sawdon . |
| 4,208,776 | 6/1980 | Schleicher . |
| 4,459,735 | 7/1984 | Sawdon . |
| 4,574,473 | 3/1986 | Sawdon . |
| 4,722,647 | 2/1988 | Sawdon . |
| 4,738,130 | 4/1988 | Homma . |
| 4,757,609 | 7/1988 | Sawdon . |
| 4,825,525 | 5/1989 | Obrecht et al. . |
| 4,878,284 | 11/1989 | Sawdon . |
| 4,905,362 | 3/1990 | Obrecht et al. . |
| 4,910,853 | 3/1990 | Sawdon . |
| 4,912,961 | 4/1990 | Brown . |
| 4,930,203 | 6/1990 | Obrecht et al. . |
| 5,027,503 | 7/1991 | Sawdon . |
| 5,031,442 | 7/1991 | Kynl . |
| 5,131,258 | 7/1992 | Kynl . |
| 5,150,513 | 9/1992 | Sawdon . |
| 5,177,861 | 1/1993 | Sawdon . |
| 5,207,086 | 5/1993 | Kynl . |
| 5,208,973 | 5/1993 | Sawdon . |
| 5,208,974 | 5/1993 | Sawdon et al. . |
| 5,267,383 | 12/1993 | Sawdon . |
| 5,339,509 | 8/1994 | Sawdon et al. . |
| 5,435,049 | 7/1995 | Sawdon . |
| 5,479,687 | 1/1996 | Sawdon . |
| 5,509,290 | 4/1996 | Faivre . |
| 5,528,815 | 6/1996 | Webb . |
| 5,581,860 | 12/1996 | Sawdon . |

FOREIGN PATENT DOCUMENTS

| | | |
|---|---|---|
| 20645 | 10/1954 | Australia . |
| 1452782 | 3/1969 | Germany . |
| 3726392 A1 | 2/1989 | Germany . |
| 4335318 A1 | 4/1994 | Germany . |
| 56-50732(A) | 5/1981 | Japan . |
| 62-148035(A) | 7/1987 | Japan . |
| 62-148036(A) | 7/1987 | Japan . |
| 62-148039 | 7/1987 | Japan . |
| 62-148040(A) | 7/1987 | Japan . |
| 4-15944(A) | 6/1992 | Japan . |
| 161209 | 4/1964 | U.S.S.R. . |
| 1299669 | 3/1987 | U.S.S.R. . |
| WO 93 14893 | 8/1993 | WIPO . |

OTHER PUBLICATIONS

D. Eary, et al., "Techniques of Pressowrking Sheet Metal", Second Edition, Prentice Hall, Inc., pp. 332–333, FIG. 300 (1974).

BTM Tog-L-Loc 940 Series Sheet Metal Joining System (prior to Nov. 4, 1996).

American Society of Tool Engineers, Tool Engineers Handbook, Sections 97 and 98, pp. 1494–1578 (1949).

*Primary Examiner*—David Jones

*Attorney, Agent, or Firm*—Harness, Dickey & Pierce, P.L.C.

[57] ABSTRACT

An apparatus for retaining a tool (20) employs a fastener (22) which has a protuberance (122) engagable with a recess (60) of the tool. The fastener (22) is secured to a fixture (24) thereby serving to concurrently retain the tool (20) to the fixture (24).

33 Claims, 4 Drawing Sheets

FIG 1
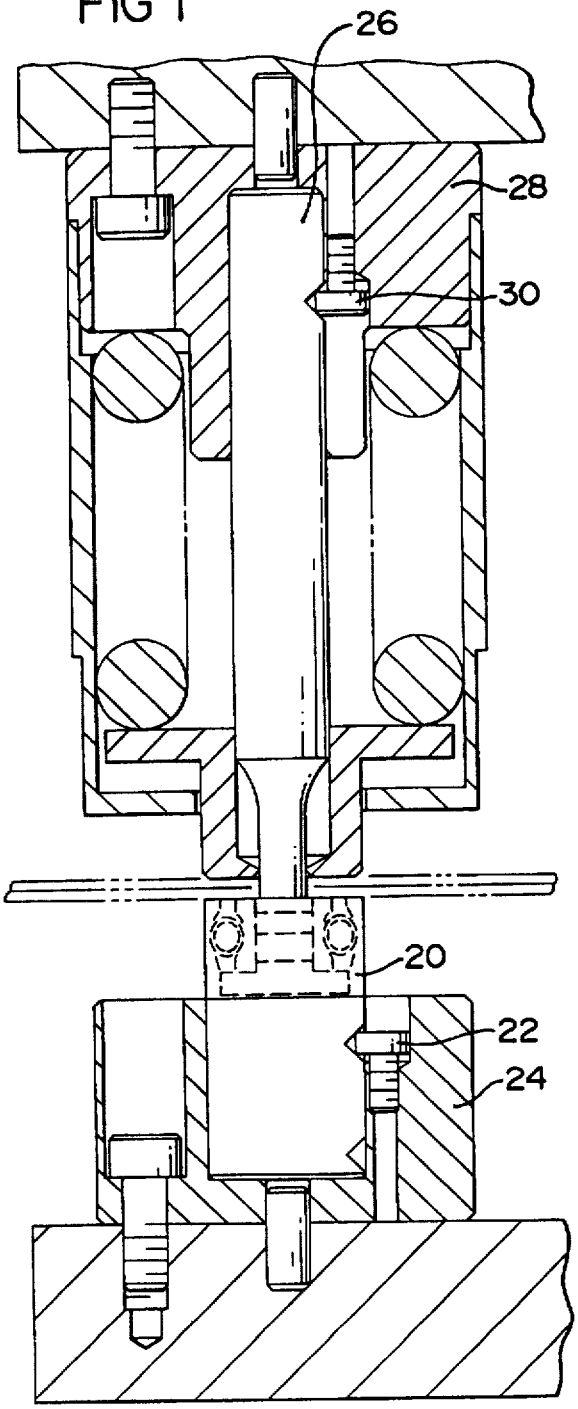
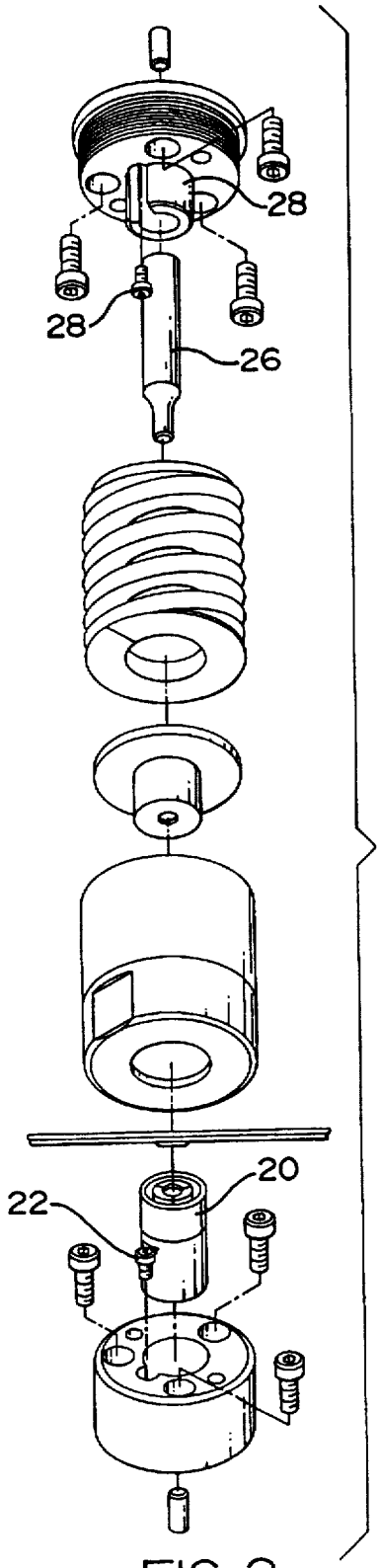
FIG 2

FIG 3
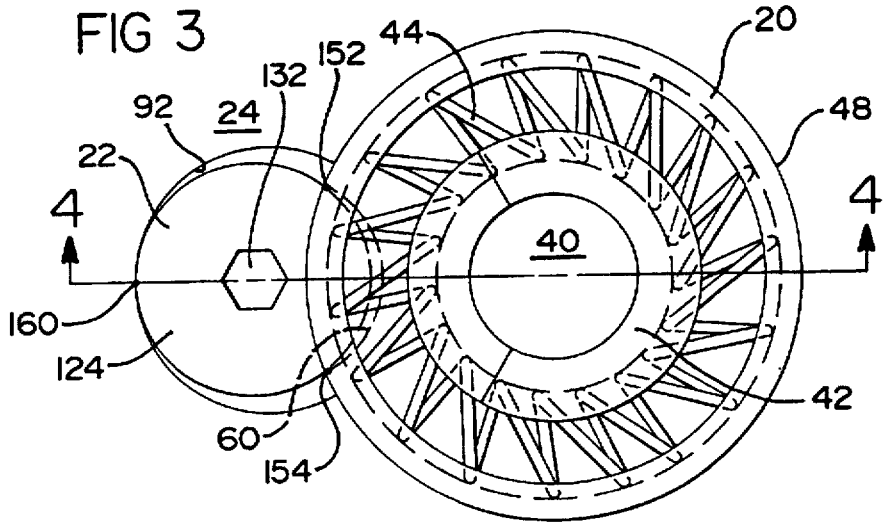
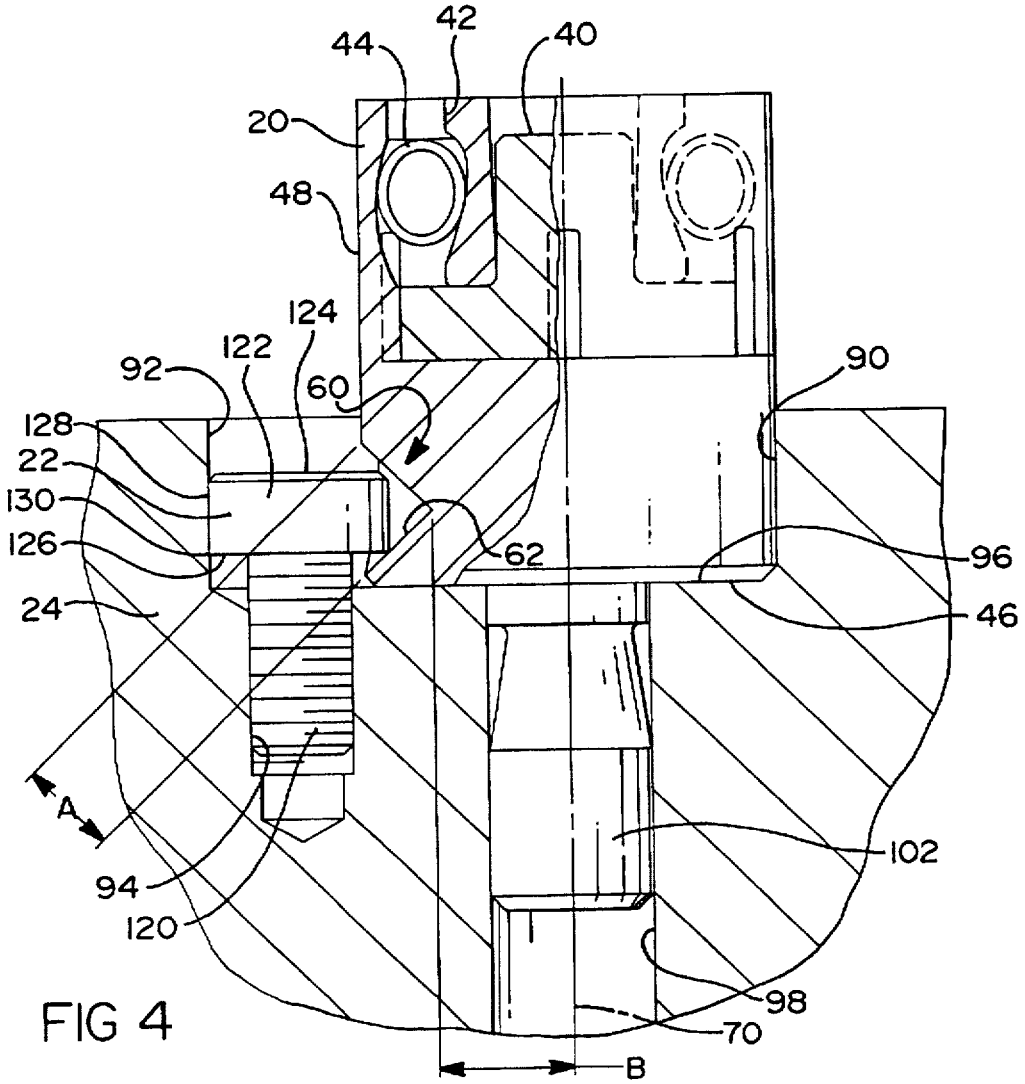
FIG 4

FIG 5
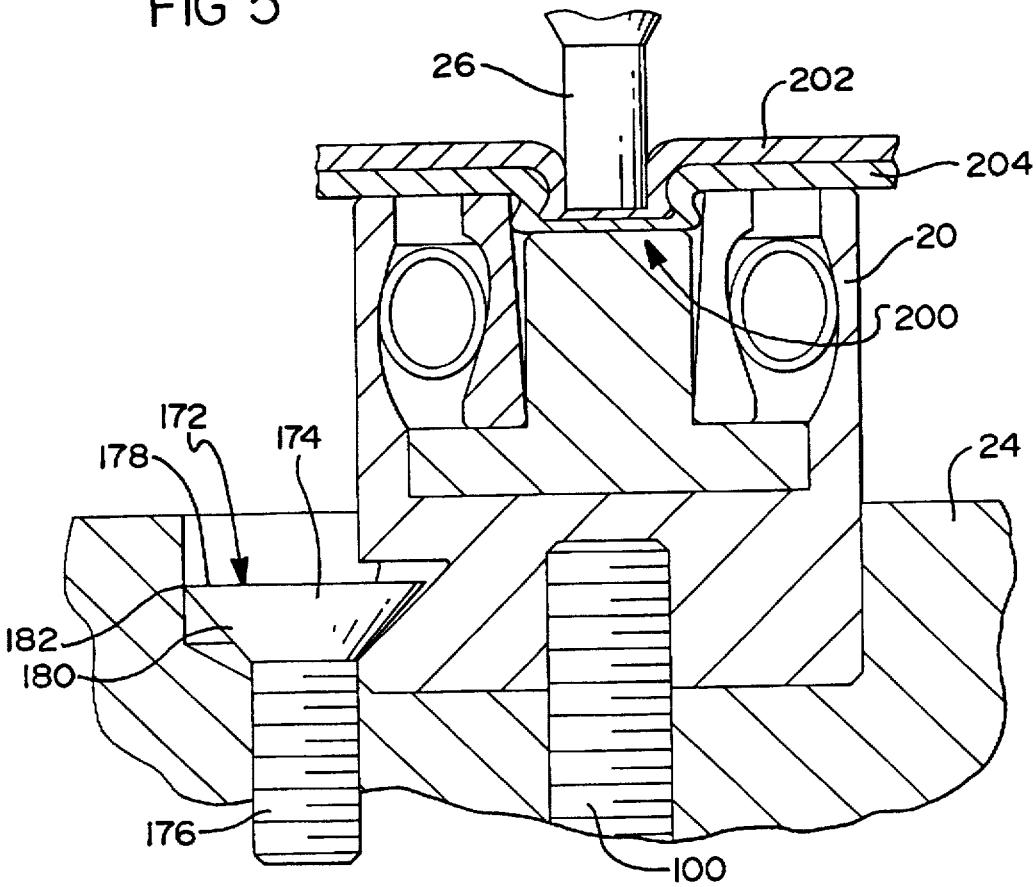
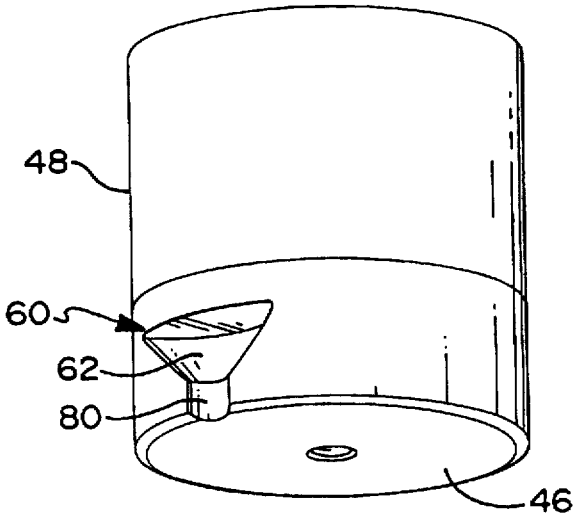
FIG 6

FIG 7
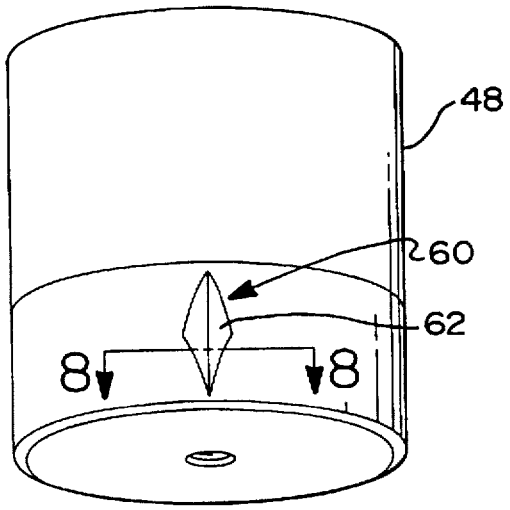
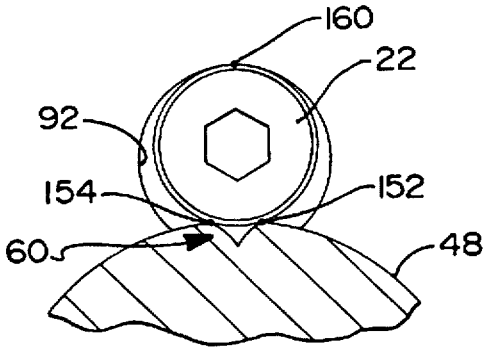
FIG 8

APPARATUS FOR RETAINING TOOLS

BACKGROUND AND SUMMARY OF THE INVENTION

This is a continuation of PCT patent application Ser. No. PCT/US94/08561 filed Jul. 29, 1994, which designated the United States.

This invention relates generally to an apparatus for retaining a tool to a fixture and specifically to a fastener having a protuberance which engages an aperture within a tool.

Within the equipment, tool and die making industries, it is common to provide various fastening means between machinery components. For example, sheet metal stamping and injection molding dies are typically fastened to their respective die plates by bolts extending through holes within the die. These bolts have a head which engages the die and a threaded shank which enmeshes with a receiving hole within the die plate. Typically, four or more bolts are required to retain each die.

Another conventional system provides a T-bolt and an L-shaped brace to secure a die to a bolster plate. Such a system is shown in U.S. Pat. No. 4,912,961 entitled "Structure for Securing a Die to a Bolster Plate" which issued to Brown on Apr. 3, 1990. A riveting instrument has also employed a pair of fingers fastened to a side plate. The fingers retain a malleable anvil piece. This device is disclosed within U.S. Pat. No. 1,211,333 entitled "Riveting Instrument" which issued on Jan. 2, 1917. Yet another device is shown within U.S. Pat. No. 1,190,697 entitled "Means for Shaping Spoon Bowls and the Like" which issued to Wilzin on Jul. 11, 1916. This patent teaches use of four bars which are screwed to a tool holder. These bars act to retain contoured confining dies against the tool holder. However, all of these retention means require extraneous and relatively costly clamps and fasteners.

Yet another conventional construction has employed a set screw to retain a TOG-L-LOC® joint die within a die shoe.

In accordance with the present invention, the preferred embodiment of an apparatus for retaining a tool is comprised of a fastener which has a protuberance engagable with a recess of a tool. The fastener is secured to a fixture thereby serving to concurrently retain the tool to the fixture. In one aspect of the present invention, a bore within the fixture has a head of the fastener disposed therein. This bore prevents extreme deformation of the fastener upon securing the tool to the fixture.

The apparatus of the present invention is advantageous over traditional retention devices since the present invention only requires a single fastener for retaining a tool to a fixture. Thus, quick retention and removal can be affected. This leads to low cost and quick tool set-up. The apparatus of the present invention further provides a very secure retention of the tool to the fixture. The present invention apparatus is also advantageous over conventional designs in that the present invention construction can be employed in combination with any number of different tool and fixture types. The present invention is also much more compact than are the prior art devices. The apparatus of the present invention is also stronger and more reliable than traditional set screw systems. It is also self-centering and prevented from rotation. Additional advantages and features of the present invention will become apparent from the following description and appended claims, taken in conjunction with the accompanying drawings.

BRIEF DESCRIPTION OF THE DRAWINGS

FIG. 1 is a side elevational view, partially in section, of a punch assembly and die assembly employing a preferred embodiment of the apparatus of the present invention;

FIG. 2 is an exploded perspective view showing a first alternate embodiment of the present invention apparatus in combination with the punch and die assemblies of FIG. 1;

FIG. 3 is a top elevational view showing the preferred embodiment of the present invention apparatus in combination with a die assembly similar to that of FIG. 1;

FIG. 4 is a side elevational view, partially in section as taken along line 4—4 of FIG. 3, showing the preferred embodiment of the present invention apparatus in combination with the die assembly;

FIG. 5 is a side elevational view, similar to that of FIG. 4, showing a second alternate embodiment of the present invention apparatus in combination with a die assembly;

FIG. 6 is a perspective view showing the first alternate embodiment of the present invention apparatus of FIG. 2;

FIG. 7 is a perspective view diagrammatically showing an alternate embodiment recess within a die assembly of the present invention apparatus of FIG. 1; and FIG. 8 is a sectional view, taken along line 8—8 of FIG. 7, showing a bolt and fixture in relation to the alternate embodiment recess.

DETAILED DESCRIPTION OF THE PREFERRED EMBODIMENT

An apparatus of the present invention serves to secure a tool to a fixture. The present invention apparatus may be employed with tools such as dies, molds, punches, shearing blades, corner braces or the like. The present invention retaining apparatus may also be used for various fixtures such as die shoes, die plates, presses, building floors, building walls, tables or the like. Referring to FIG. 1, a preferred embodiment of an apparatus of the present invention for retaining tools includes a die 20, a fastener 22 and a die shoe 24. The apparatus of the present invention is also used to retain a punch 26 to a punch holder 28 by way of a fastener 30.

As can best be observed in FIGS. 3 and 4, die 20 is generally of the type disclosed within U.S. Pat. No. 5,150,513 entitled "Apparatus for Joining Sheet Material" which issued to Sawdon on Sep. 29, 1992, and is incorporated by reference herewithin. Die 20 includes an anvil 40, a set of movable blades 42 and an expandable retention spring 44. Die 20 also has a bottom 46 and a cylindrical side 48. A recess 60 is cut by an end mill into side wall 48 of die 20. A circular mill cutter may also be used to cut a recess as is alternately shown in FIGS. 7 and 8. Returning to FIGS. 3 and 4, a tapered portion 62 is located along recess 60. Recess 60 is cut within die 20 such that dimension A preferably has a diameter of 0.250 inches as measured 45° from a longitudinal axis 70 of die 20. A dimension B between an apex of recess 60 and axis 70 of die 20 is preferably 0.222 inches. Of course, other sizes can be used depending on the specific tool to be retained. In the alternate embodiment shown in FIGS. 2 and 6, recess 60 further has a semi-cylindrical channel 80 projecting in a longitudinal manner along side 48 so as to extend between the lowermost portion of tapered surface 62 and bottom 46.

Referring again to FIGS. 3 and 4, die shoe 24 has a cylindrical cavity 90 cut therein for receiving a lower portion of die 20. A counterbore 92 is also cut within die shoe 24. Counterbore 92 further has a threaded shaft 94 centrally extending therebelow. A ledge 96 is located along the bottom of cavity 90 with a duct 98 projecting downwardly therefrom. Either a threaded dowl 100 (as is shown in FIG. 5) or a nonthreaded dowl 102 (as is shown in FIG.

4) is engaged with duct 98 while the opposite end of dowl 100 or 102 is secured to die 20.

The preferred embodiment of the fastener 22 of the present invention includes a threaded longitudinal shank 120 with a protuberance or head 122 laterally extending therefrom. Head 122 is defined by an upper surface 124, a lower and substantially parallel surface 126 and a cylindrical peripheral surface 128. A lower peripheral edge 130 is located at the intersection of lower surface 126 and peripheral surface 128. Upper surface 124 of fastener 22 further has a hexagonal shaped wrench receiving depression 132 formed centrally therein.

When die 20 is inserted within cavity 90 of die shoe 24, and dowl 102 is inserted within duct 98, shank 120 of fastener 22 is threadably engaged with shaft 94. Concurrently, lower peripheral edge 130 of head 122 is snugged against tapered surface 62 of recess 60 at contact points 152 and 154. Thus, fastener 22 serves to secure die 20 against die shoe 24. Preferably an M4×0.7×8 mm socket, low head, cap screw is used for fastener 22. Other size screws may also be employed. Counterbore 92 has a larger diameter than does peripheral surface 128 of fastener 22. Accordingly, peripheral surface 128 of fastener 22 contacts against counterbore 92 at contact point 160 when fastener 22 secures die 20 to die shoe 24. Counterbore 92 prevents excessive bending or healing of fastener 22 when secured. The two point contact of fastener 22 to die 20 causes self centering of die 20.

For the alternate embodiment die of FIGS. 2 and 6, the shank of fastener 22 is partially disposed within channel 80 of die 48 when secured. The retention apparatus construction described heretofore also applies to the punch 26 and punch holder 28 shown in FIGS. 1 and 2.

Another alternate embodiment of the present invention apparatus is shown in FIG. 5. In this embodiment, a #6-32 screw 172 has a head 174 and a longitudinal shank 176. Head 174 is defined by an upper surface 178 and a tapered peripheral surface 180. A longitudinal peripheral edge 182 is defined at an intersection between tapered surface 180 and upper surface 178. Screw 172 serves to secure die 20 to die shoe 24 in a manner similar to that of the preferred embodiment. FIG. 5 further shows an interlocking leakproof joint 200 formed between two sheets of material 202 and 204. Such a joint 200 is formed between drawing punch 22 and die 20 of any of the previously disclosed embodiments.

While the preferred embodiment of the apparatus for retaining tools has been disclosed, it will be appreciated that various modifications may be made without departing from the present invention. For example, the recess within the tool may be defined by many other shapes. Similarly, the fastener protuberance may have many alternate shapes and may even be a portion of the fastener other than the head thereof. It will also be appreciated that a plurality of recesses and fasteners may be employed to retain a single tool. Also, a dowl may not be required. Noncircular tools may also use the retention device of the present invention. Various dimensions have been disclosed in an exemplary fashion, however, other dimensions and fastener types may of course be employed. It is intended by the following claims to cover these and any other departures from the disclosed embodiments which fall within the true spirit of this invention.

The invention claimed is:

1. An apparatus for retaining tools to a fixture, said apparatus comprising:

a side of a tool having a partially conical recess, a bottom of said tool disposed upon said fixture; and a fastener having a longitudinal shank and a laterally extending head mounted to said shank, said head being engagable with said recess of said tool, said shank of said fastener being securely and disengagably attachable to said fixture, said shank being threaded, said fastener serving to retain said tool to said fixture.

2. The apparatus of claim 1 wherein said head of said fastener includes an upper surface and a lower surface joined by a peripheral surface, said upper surface and said lower surface extending substantially perpendicular to said longitudinal shank.

3. The apparatus of claim 2 wherein a lower peripheral edge defined at an intersection between said bottom surface and said peripheral surface of said head securely contacts against said recess of said tool.

4. The apparatus of claim 1 wherein said head of said fastener includes a tapered peripheral surface extending from said longitudinal shank to an upper surface, said head further includes a peripheral edge located at an intersection between said tapered surface and said upper surface.

5. The apparatus of claim 4 wherein at least a portion of said tapered surface of said fastener securely contacts against said recess of said tool.

6. The apparatus of claim 1 wherein said shank is threadably enmeshed with a threaded portion of said fixture.

7. The apparatus of claim 1 wherein said recess of said tool has a tapered surface.

8. The apparatus of claim 7 wherein said recess of said tool further has a channel extending between said tapered surface and said bottom of said tool.

9. The apparatus of claim 8 wherein said shank of said fastener is at least partially disposed within said channel of said recess.

10. The apparatus of claim 7 further comprising:

a peripheral edge of said fastener head having a first diameter; and said tapered surface of said tool recess, where contacting with said peripheral edge, having a second diameter less than said first diameter;

whereby said fastener head provides contact against said tool recess at only two contact points.

11. The apparatus of claim 1 wherein said tool is a die.

12. The apparatus of claim 11 wherein said die includes an anvil, at least one movable blade and a means for expansion.

13. The apparatus of claim 1 further comprising at least a portion of said fastener locatable in a bore of said fixture.

14. The apparatus of claim 13 wherein said portion of said fastener in said bore is said head whereby said bore prevents excessive deformation of said fastener away from said recess of said tool upon securing said tool to said fixture.

15. The apparatus of claim 14 wherein said bore has a diameter larger than a diameter of a peripheral surface of said fastener head.

16. The apparatus of claim 1 further comprising:

a dowl extending between said tool and said fixture operable for further preventing independent movement between said tool and said fixture.

17. The apparatus of claim 1 wherein said tool is a punch.

18. The apparatus of claim 1 further comprising:

a leakproof joint formed between at least two coplanar sheets of material by said tool.

19. The apparatus of claim 1 wherein said fixture is a die shoe.

20. The apparatus of claim 1 wherein said fixture is a table.

21. In combination, a joint and an apparatus for retaining a die to a fixture, said combination comprising:

a side of said die having a recess, a bottom of said die disposed upon said fixture, a tapered surface disposed upon said recess of said die, said die having an anvil and at least one blade;

a fastener having a longitudinal shank and a single laterally extending protuberance engagable with said tapered surface of said die, said shank of said fastener being securely attachable to said fixture, said fastener serving to retain said die to said fixture;

a peripheral edge of said fastener protuberance having a first diameter;

said tapered surface of said die recess, where contacting with said peripheral edge, having a second diameter less than said first diameter, whereby said fastener protuberance provides downward contact against said die recess at only two contact points;

said fixture having a bore within which said protuberance of said fastener is locatable, a surface of said protuberance substantially opposite from said recess abutting against a portion of said bore upon securing said shank to said fixture, whereby said bore prevents excessive deformation of said fastener away from said recess of said die upon securing said die to said fixture;

a dowl extending between said die and said fixture for further deterring independent movement between said die and said fixture; and a punch;

said joint being formable between at least two coplanar sheets of material by compression of said punch against said die.

22. A method for retaining a tool to a fixture by use of a threaded fastener having an enlarged head, said method comprising the steps of:

(a) creating a rounded and tapered recess within a side of said tool;

(b) engaging said enlarged head of said threaded fastener directly against said recess of said tool; and (c) securing said fastener to said fixture which acts to secure said tool to said fixture.

23. The method of claim 22 further comprising the steps of:

(a) inserting said protuberance of said fastener within a bore located in said fixture; and (b) enmeshing threads of a shaft of said fastener to congruent threads of said fixture.

24. The method of claim 22 further comprising the steps of:

(a) engaging a dowl with said tool; and (b) engaging said dowl with said fixture.

25. A method for retaining a tool to a fixture by use of a threaded fastener having a head, said method comprising the steps of:

(a) creating at least one tapered recess within a side of said tool;

(b) engaging said head of said threaded fastener directly against said recess of said tool;

(c) securing said fastener to said fixture which acts to secure said tool to said fixture;

(d) positioning a substantially cylindrical and axially elongated portion of said fastener in a channel, said channel being axially located in said side of said tool and connecting with said recess.

26. An apparatus for retaining tools to a fixture, said apparatus comprising:

a side of a tool having a recess, said tool having a bottom disposed upon said fixture;

a fastener having a longitudinal shank and a laterally extending protuberance, said protuberance being engagable with said recess of said tool, said shank of said fastener being securely attachable to said fixture, said fastener serving to retain said tool to said fixture; and a channel being axially located in said side of said tool and connecting with said recess, a portion of said shank located in said channel.

27. An apparatus for retaining tools to a fixture, said apparatus comprising:

a side of an externally cylindrical tool having a recess, a bottom of said tool disposed on said fixture;

a fastener having a longitudinal shank and a laterally extending protuberance, said protuberance being engagable with said recess of said tool, said shank of said fastener being securely attachable to said fixture, said fastener serving to retain said tool to said fixture;

a peripheral edge of said fastener protuberance having a first diameter;

a second diameter of said partially conical surface of said tool recess, where contacting with said peripheral edge, being less than said first diameter;

a tapered peripheral surface of said head extending from said longitudinal shank to an upper surface and a peripheral edge defined at an intersection between said tapered surface and said upper surface; and at least a portion of said tapered surface of said fastener securely contacting against said recess of said tool;

whereby said fastener protuberance provides downward contact against said tool recess at two contact points.

28. The apparatus of claim 27 wherein said tool is a sheet metal joining die including:

a stationary anvil; and a set of movable die blades laterally surrounding said anvil.

29. An apparatus for retaining tools to a fixture, said apparatus comprising:

a side of an externally cylindrical tool having a recess, a bottom of said tool disposed on said fixture;

a fastener having a longitudinal shank and a laterally extending head, said head being engagable with said recess of said tool, said shank of said fastener being securely attachable to said fixture, said fastener serving to retain said tool to said fixture;

a peripheral edge of said fastener head having a first diameter;

a second diameter of said partially conical surface of said tool recess, where contacting with said peripheral edge, being less than said first diameter;

whereby said fastener head provides downward contact against said tool recess at two contact points;

said fastener being disengagably attachable to said fixture;

said shank being threaded;

said head of said fastener having an upper surface and a lower surface joined by a peripheral surface, said upper surface and said lower surface extending substantially perpendicular to said longitudinal shank; and a lower peripheral edge defined at an intersection between said bottom surface and said peripheral surface of said head securely contacting against said recess of said tool.

30. An apparatus for retaining tools to a fixture, said apparatus comprising:

a side of an externally cylindrical tool having a recess, a bottom of said tool disposed upon said fixture;

a fastener having a longitudinal shank and a laterally extending protuberance, said protuberance being engagable with said recess of said tool, said shank of said fastener being securely attachable to said fixture, said fastener serving to retain said tool to said fixture;

a tapered surface disposed on said recess of said tool; and a channel extending between said tapered surface and said bottom of said tool;

said shank of said fastener being at least partially disposed within said channel of said recess.

31. An apparatus for retaining tools to a fixture, said apparatus comprising:

a side of a tool having a substantially diamond-shaped recess, a bottom of said tool disposed upon said fixture; and a fastener having a longitudinal shank and a laterally extending protuberance, said protuberance being engagable with said recess of said tool, said shank of said fastener being securely attachable to said fixture, said fastener serving to retain said tool to said fixture.

32. The apparatus of claim 31 wherein:

said fastener is disengagably attachable to said fixture;

said shank is threaded;

said protuberance is a head mounted to said shank;

said head of said fastener has an upper surface and a lower surface joined by a peripheral surface, said upper surface and said lower surface extend substantially perpendicular to said longitudinal shank; and a lower peripheral edge defined at an intersection between said bottom surface and said peripheral surface of said head securely contacts against said recess of said tool.

33. The apparatus of claim 32 wherein:

said head of said fastener has a tapered peripheral surface extending from said longitudinal shank to an upper surface and a peripheral edge defined at an intersection between said tapered surface and said upper surface; and at least a portion of said tapered surface of said fastener securely contacts against said recess of said tool.

* * * * *

UNITED STATES PATENT AND TRADEMARK OFFICE

CERTIFICATE OF CORRECTION

PATENT NO. : 5,782,130
DATED : July 21, 1998
INVENTOR(S) : Edwin G. Sawdon

It is certified that error appears in the above-indentified patent and that said Letters Patent is hereby corrected as shown below:

On the Title Page, under U.S. Patent Documents, insert

-- 4,736,612 4/1988 Russell --
-- 4,096,776 6/1978 Laucke --
-- 3,715,947 2/1973 Weisbeck et al --
-- 3,137,193 6/1964 Whistler, SR., et al --
-- 2,393,986 2/1946 Gullberg --.

On the Title Page, under Foreign Patent Documents, reference 4-15944(A), "4-15944(A)" should be -- 4-158944(A) --.

On the Title Page, under Foreign Patent Documents, insert -- 58-168454 10/1983 Japan --
-- 127,231 1/1960 Soviet Union --.

On the Title Page, under Other Publications, line 1, "Pressowrking" should be -- Pressworking --.

Column 3, line 66, delete "a side of".

Column 3, line 66, after "having" insert -- a side with --.

Column 5, line 60, after "fixture" insert -- thereby securing --.

Column 5, lines 60,61, delete "which acts to secure".

Column 6, line 1, delete "a side of".

UNITED STATES PATENT AND TRADEMARK OFFICE

CERTIFICATE OF CORRECTION

PATENT NO. : 5,782,130
DATED : July 21, 1998
INVENTOR(S) : Edwin G. Sawdon

It is certified that error appears in the above-indentified patent and that said Letters Patent is hereby corrected as shown below:

Column 6, line 1, after "having" (first occurrence) insert -- a side with --.

Column 6, line 8, delete "being".

Column 6, line 42, delete "a side of".

Column 6, line 42, after "having" insert -- a side with --.

Column 6, line 52, after "of" (first occurrence) insert -- a --.

Column 6, line 52, delete "said" (first occurrence).

Column 6, line 66, delete "against".

Signed and Sealed this

Tenth Day of November 1998

Bruce Lehman

*Attest:*

BRUCE LEHMAN

*Attesting Officer*

*Commissioner of Patents and Trademarks*